US009726175B2

(12) United States Patent
Kim et al.

(10) Patent No.: US 9,726,175 B2
(45) Date of Patent: Aug. 8, 2017

(54) SCROLL COMPRESSOR HAVING A BACK PRESSURE PLATE AND A GASKET COUPLED TO A FIXED SCROLL PLATE BY AT LEAST ONE COUPLING MEMBER

(71) Applicant: LG ELECTRONICS INC., Seoul (KR)

(72) Inventors: Suchul Kim, Seoul (KR); Kiwon Park, Seoul (KR); Minjae Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 232 days.

(21) Appl. No.: 14/702,968

(22) Filed: May 4, 2015

(65) Prior Publication Data

US 2015/0316056 A1 Nov. 5, 2015

(30) Foreign Application Priority Data

May 2, 2014 (KR) ..... 10-2014-0053651

(51) Int. Cl.
*F03C 2/00* (2006.01)
*F03C 4/00* (2006.01)
(Continued)

(52) U.S. Cl.
CPC ..... *F04C 27/003* (2013.01); *F01C 1/0215* (2013.01); *F01C 1/0261* (2013.01);
(Continued)

(58) Field of Classification Search
CPC ..... F04C 18/0215; F04C 18/0261; F04C 18/0253; F04C 15/0011; F04C 15/0023;
(Continued)

(56) References Cited

U.S. PATENT DOCUMENTS 5,101,555 A 4/1992 Hauser
7,735,335 B2 * 6/2010 Uno ..... F01C 11/004 62/467
(Continued)

FOREIGN PATENT DOCUMENTS

CN 102449313 5/2012
CN 102650294 8/2012
(Continued)

OTHER PUBLICATIONS

European Search Report issued in Application No. 15165692.3 dated Jul. 24, 2015.
(Continued)

*Primary Examiner* — Theresa Trieu
(74) *Attorney, Agent, or Firm* — KED & Associates, LLP

(57) ABSTRACT

A scroll compressor is provided. The scroll compressor may include a casing, a discharge cover to partition an inside of the casing into suction and discharge spaces, a first scroll, a second scroll that defines compression chambers together with the first scroll and includes an intermediate pressure discharge hole that communicates with a compression chamber having an intermediate pressure of the compression chambers, a back pressure plate that defines a back pressure chamber that accommodates a refrigerant discharged from the intermediate pressure discharge hole, a floating plate that defines the back pressure chamber together with the back pressure plate, and a gasket disposed between the back pressure plate and the second scroll and having an intermediate pressure communication hole that allows the intermediate pressure discharge hole to communicate with the intermediate pressure suction hole. The gasket may block communication between the back pressure chamber and the suction and discharge spaces.

18 Claims, 13 Drawing Sheets

(51) Int. Cl.

| | |
|---|---|
| ***F04C 2/00*** | (2006.01) |
| ***F04C 27/00*** | (2006.01) |
| ***F04C 29/12*** | (2006.01) |
| ***F04C 15/00*** | (2006.01) |
| ***F01C 1/02*** | (2006.01) |
| ***F01C 19/00*** | (2006.01) |
| ***F04C 18/02*** | (2006.01) |
| *F04C 23/00* | (2006.01) |
| *F04C 28/06* | (2006.01) |

(52) U.S. Cl.
CPC ..... *F01C 19/005* (2013.01); *F04C 15/0023* (2013.01); *F04C 18/0215* (2013.01); *F04C 27/008* (2013.01); *F04C 29/12* (2013.01); *F04C 18/0261* (2013.01); *F04C 23/008* (2013.01); *F04C 28/06* (2013.01); *F04C 29/124* (2013.01); *F05C 2225/00* (2013.01); *F05C 2225/02* (2013.01)

(58) Field of Classification Search
CPC ..... F04C 23/008; F04C 2230/91; F04C 2230/92; F04C 27/003; F04C 27/008; F04C 28/06; F04C 29/12; F04C 29/124; F04C 19/005; F05C 2225/04; F05C 2225/00; F05C 2225/02; F01C 1/0215; F01C 1/0261; F01C 1/0253
USPC ..... 418/104, 55.1–55.6, 57, 152–153, 418/178–179, 180, 270
See application file for complete search history.

(56) References Cited

U.S. PATENT DOCUMENTS

| | | | |
|---|---|---|---|
| 2002/0085938 | A1 | 7/2002 | Gennami et al. |
| 2010/0303659 | A1 | 12/2010 | Stover et al. |

FOREIGN PATENT DOCUMENTS

| | | | |
|---|---|---|---|
| EP | 2 492 509 | A2 | 8/2012 |
| JP | 2001-132629 | A | 5/2001 |
| JP | 2007-009776 | A | 1/2007 |
| KR | 10-2012-0081488 | | 7/2012 |

OTHER PUBLICATIONS

Chinese Office Action dated Oct. 8, 2016 issued in Application No. 201510221490.2 (with English translation).

* cited by examiner

SCROLL COMPRESSOR HAVING A BACK PRESSURE PLATE AND A GASKET COUPLED TO A FIXED SCROLL PLATE BY AT LEAST ONE COUPLING MEMBER

CROSS-REFERENCE TO RELATED APPLICATION(S)

The present application claims priority under 35 U.S.C. 119 and 35 U.S.C. 365 to Korean Patent Application No. 10-2014-0053651, filed in Korea on May 2, 2014, which is hereby incorporated by reference in its entirety.

BACKGROUND

1. Field

A compressor is disclosed herein.

2. Background

A scroll compressor is a compressor that includes a fixed scroll having a spiral wrap, and an orbiting scroll that revolves with respect to the fixed scroll, that is, a compressor in which the fixed scroll and the orbiting scroll are engaged with each other. The orbiting scroll revolves with respect to the fixed scroll, thereby reducing a volume of a compression chamber, which is formed between the fixed scroll and the orbiting scroll according to an orbiting motion of an orbiting scroll, thus increasing a pressure of a fluid, which is then discharged through a discharge hole formed in a central portion of the fixed scroll.

In the scroll compressor, suction, compression, and discharge of a fluid are successively performed while the orbiting scroll revolves. Accordingly, a discharge valve and a suction valve may be unnecessary in principle. Also, as a number of components of the scroll compressor is less in comparison to other types of compressors, the scroll compressor may be simplified in structure and rotate at a high speed. Also, as a variation in torque required for compression is less, and suction and compression successively occur, a relatively small amount of noise and vibration may occur.

A scroll compressor including a separation-type orbiting scroll is disclosed in Korean Patent Publication No. 10-2012-0081488 (hereinafter, the "prior document"), published Jul. 19, 2012, which is hereby incorporated by reference. The scroll compressor according to the prior document includes an orbiting scroll formed by a wrap engaged with a fixed scroll, and a base coupled to the wrap. The base includes a base flange having a disk shape and a boss. A back pressure chamber partitioned by a sealing ring is defined in a center of a top surface of a base flange. The back pressure chamber is disposed between a bottom surface of the wrap and a top surface of the base flange. An inner space of the back pressure chamber is blocked from a lower pressure space by a seal ring, which is inserted into and fixed to the base flange.

According to the prior document, the back pressure chamber and the lower pressure space are blocked by the seal ring. The above-described seal ring may have a shape similar to an O-ring. A groove, into which the seal ring is inserted, is defined in the base, and the seal ring is accommodated in the groove.

However, according to the prior document, when the seal ring is inserted into the groove, the seal ring may be deteriorated in performance by a non-uniform thickness that occurs when the seal ring is manufactured, and a non-uniform depth that occurs when the groove, into which the seal ring is inserted, is formed in the base, causing leakage of fluid. For example, in the prior document, when a thin portion of the seal ring is inserted into a deep portion of the groove, a gap may be generated between the seal ring and the wrap, allowing the fluid to be discharged through the gap between the seal ring and the wrap.

Also, when the O-ring is used as the seal ring, the O-ring may seal two spaces. Thus, to seal at least three spaces, a plurality of O-rings have to be used. In this case, the O-ring may also be deteriorated in sealing performance by a non-uniform thickness that occurs when the O-ring is manufactured, and a non-uniform depth that occurs when the groove is formed.

BRIEF DESCRIPTION OF THE DRAWINGS

Embodiments will be described in detail with reference to the following drawings in which like reference numerals refer to like elements, and wherein.

DETAILED DESCRIPTION

Figure 1:
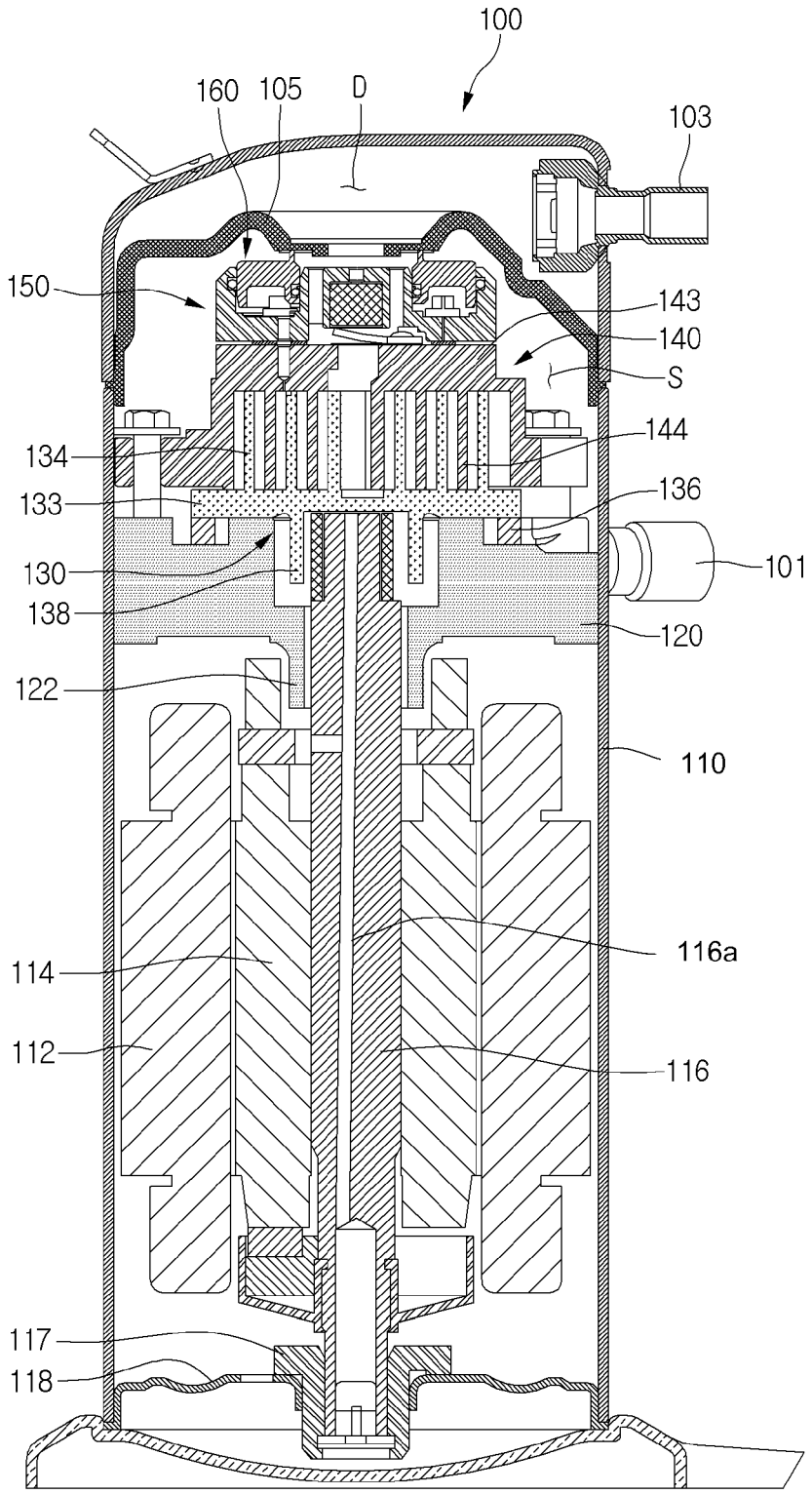
FIG. 1 is a cross-sectional view of a scroll compressor according to an embodiment.

Reference will now be made in detail to the embodiments, examples of which are illustrated in the accompanying drawings. Where possible, like reference numerals have been used to indicate like elements, and repetitive disclosure has been omitted.

In the following detailed description of embodiments, reference is made to the accompanying drawings that form a part hereof, and in which is shown by way of illustration specific embodiments which may be practiced. These embodiments are described in sufficient detail to enable those skilled in the art to practice the embodiments, and it is understood that other embodiments may be utilized and that logical structural, mechanical, electrical, and chemical changes may be made without departing from the spirit or scope. To avoid detail not necessary to enable those skilled in the art to practice the embodiments, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 2:
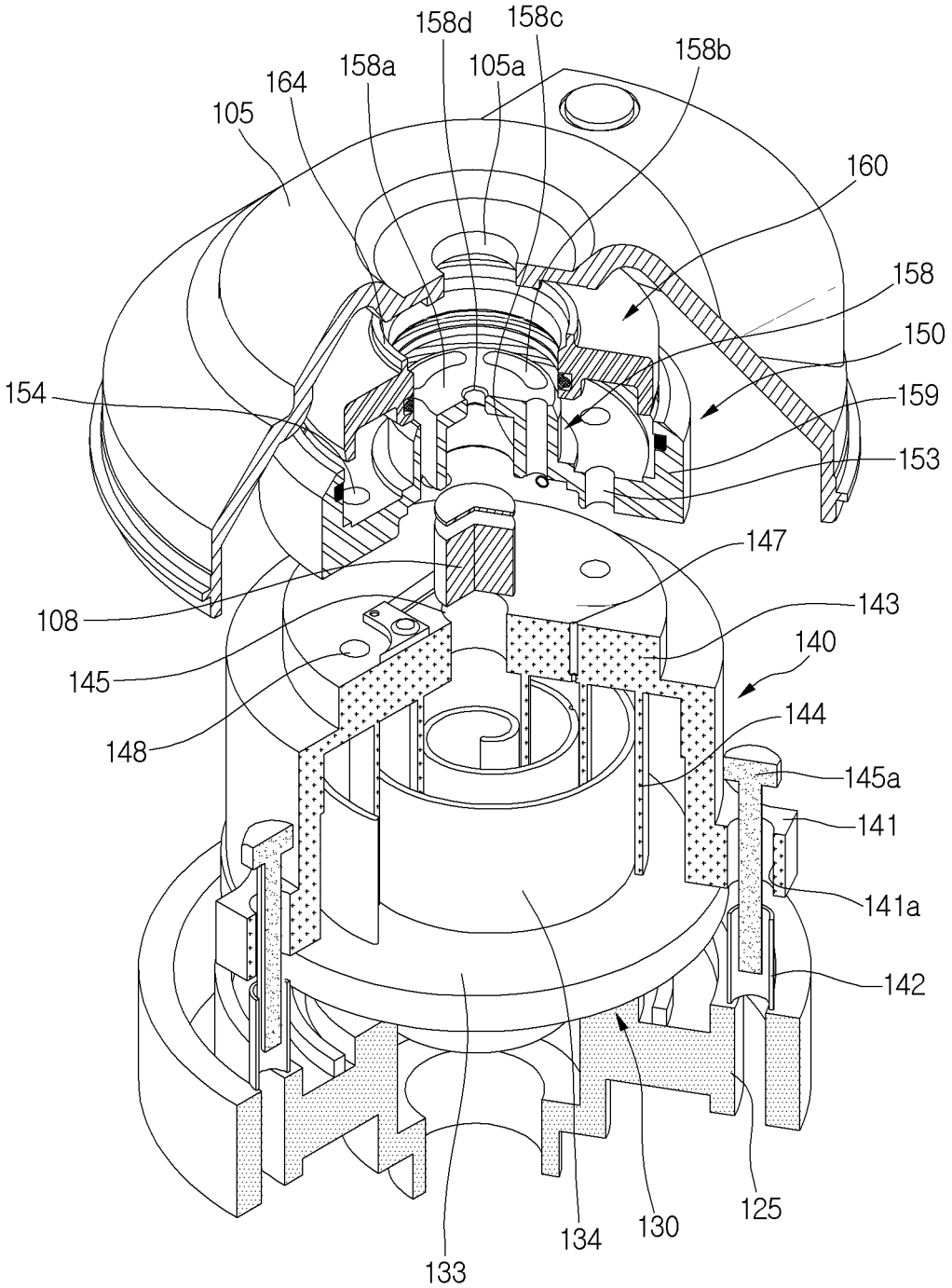
FIG. 2 is a partial exploded cross-sectional view of the scroll compressor of FIG. 1.
Figure 3:
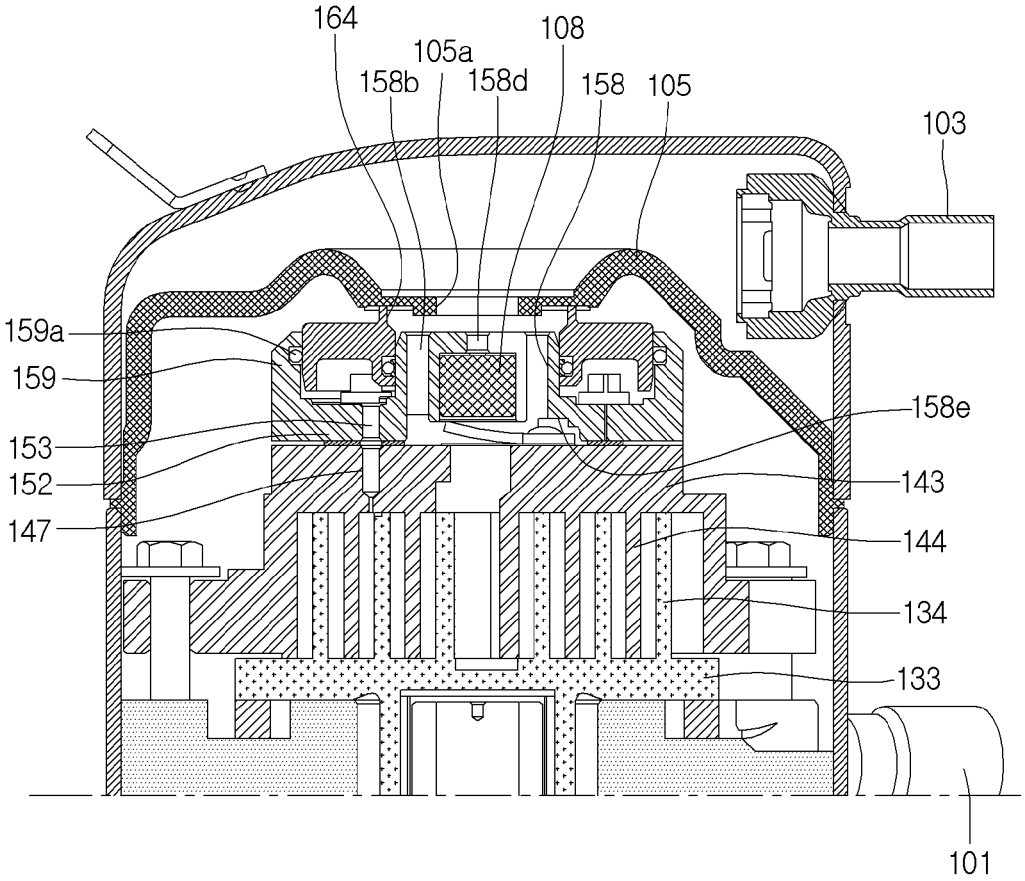
FIG. 3 is a partial cross-sectional view of the scroll compressor of FIG. 1.
Figure 4:
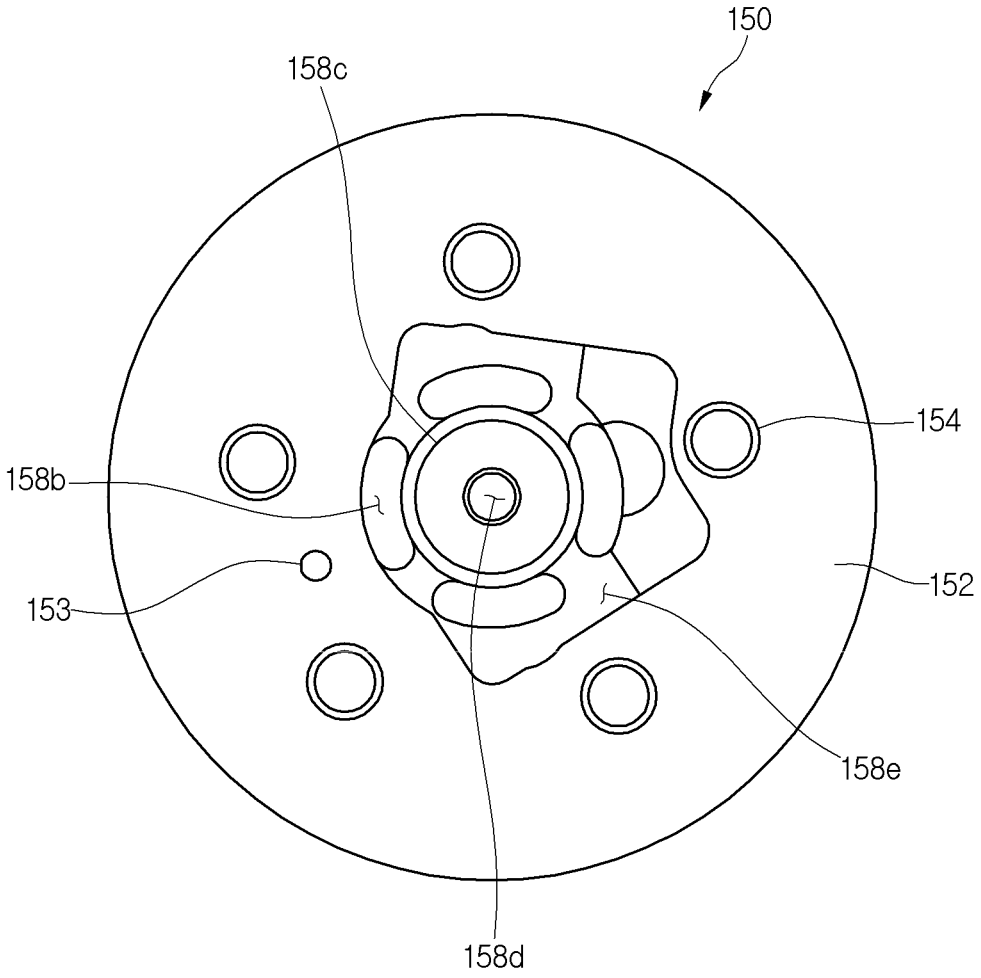
FIG. 4 is a view illustrating a bottom surface of a back pressure plate according to an embodiment.

FIG. 1 is a cross-sectional view of a scroll compressor according to an embodiment. FIG. 2 is a partial exploded cross-sectional view of the scroll compressor of FIG. 1. FIG. 3 is a partial cross-sectional view of the scroll compressor of FIG. 1. FIG. 4 is a view illustrating a bottom surface of a back pressure plate according to an embodiment.

Referring to FIGS. 1 to 4, a scroll compressor 100 according to an embodiment may include a casing 110 having a suction space S and a discharge space D. In detail, a discharge cover 105 may be disposed in or at an inner upper portion of the casing 110. An inner space of the casing 110 may be partitioned into the suction space S and the discharge space D by the discharge cover 105. An upper space of the discharge cover 105 may be the discharge space D, and a lower space of the discharge cover 105 may be the suction space S. A discharge hole 105*a*, through which a refrigerant compressed to a high pressure may be discharged, may be defined in an approximately central portion of the discharge cover 105.

The scroll compressor 100 may further include a suction port 101 that communicates with the suction space S, and a discharge port 103 that communicates with the discharge space D. Each of the suction port 101 and the discharge port 103 may be fixed to the casing 101 to allow the refrigerant to be suctioned into the casing 110 or discharged outside of the casing 110.

A motor may be disposed in the suction space S. The motor may include a stator 112 coupled to an inner wall of the casing 110, a rotor 114 rotatably disposed within the stator 112, and a rotational shaft 116 that passes through a central portion of the stator 114.

A lower portion of the rotational shaft 116 may be rotatably supported by an auxiliary bearing 117 disposed on or at a lower portion of the casing 110. The auxiliary bearing 117 may be coupled to a lower frame 118 to stably support the rotational shaft 116.

The lower frame 118 may be fixed to the inner wall of the casing 110, and an upper space of the lower frame 118 may be used as an oil storage space. Oil stored in the oil storage space may be transferred upward by an oil supply passage 116*a* defined in the rotational shaft 116 and uniformly supplied into the casing 110. The oil supply passage 116*a* may be eccentrically disposed toward one side of the rotational shaft 116, so that the oil introduced into the oil supply passage 116*a* may flow upward by a centrifugal force generated by rotation of the rotational shaft 116.

The scroll compressor 100 may further include a main frame 120. The main frame 120 may be fixed to the inner wall of the casing 110 and disposed in the suction space S.

An upper portion of the rotational shaft 116 may be rotatably supported by the main frame 120. A main bearing 122 that protrudes in a downward direction may be disposed on a bottom surface of the main frame 120. The rotational shaft 116 may be inserted into the main bearing 122. An inner wall of the main bearing 122 may function as a bearing surface so that the rotational shaft 116 may smoothly rotate.

The scroll compressor 100 may further include an orbiting scroll 130, and a fixed scroll 140. The orbiting scroll 130 may be seated on a top surface of the main frame 120.

The orbiting scroll 130 may include an orbiting head plate 133 having an approximately disk shape and disposed on the main frame 120, and an orbiting wrap 134 having a spiral shape and extending from the orbiting head plate 133. The orbiting head plate 133 may define a lower portion of the orbiting scroll 130 and function as a main body of the orbiting scroll 130, and the orbiting wrap 134 may extend in an upward direction from the orbiting head plate 133 to define an upper portion of the orbiting scroll 130. The orbiting wrap 134 together with a fixed wrap 144 of the fixed scroll 140 may define a compression chamber. The orbiting scroll 130 may be referred to as a "first scroll", and the fixed scroll 140 may be referred to as a "second scroll".

The orbiting head plate 133 of the orbiting scroll 130 may revolve in a state in which the orbiting head plate 133 is supported on the top surface of the main frame 120. An Oldham ring 136 may be disposed between the orbiting head plate 133 and the main frame 120 to prevent the orbiting scroll 130 from revolving. Also, a boss 138, into which the upper portion of the rotational shaft 116 may be inserted, may be disposed on a bottom surface of the orbiting head plate 133 of the orbiting scroll 130 to easily transmit a rotational force of the rotational shaft 116 to the orbiting scroll 130.

The fixed scroll 140 engaged with the orbiting scroll 130 may be disposed on the orbiting scroll 130. The fixed scroll 140 may include a plurality of coupling guides 141, each of which may define a guide hole 141*a*.

The compressor 100 may further includes a guide pin 142 inserted into the guide hole 141*a* and disposed on a top surface of the main frame 120, and a coupling member 145*a* inserted into the guide pin 142 and fitted into an insertion hole 125 of the main frame 120.

The fixed scroll 140 may include a fixed head plate 143 having an approximately disk shape, and the fixed wrap 144 that extends from the fixed head plate 143 toward the orbiting head plate 133 and engaged with the orbiting wrap 134 of the orbiting scroll 130. The fixed head plate 143 may define an upper portion of the fixed scroll 140 and function as a main body of the fixed scroll 140, and the fixed wrap 144 may extend in a downward direction from the fixed head plate 143 to define a lower portion of the fixed scroll 140. The orbiting head plate 133 may be referred to as a "first head plate", and the fixed head plate 143 may be referred to as a "second head plate". The orbiting wrap 134 may be referred to as a "first wrap", and the fixed wrap 144 may be referred to as a "second wrap".

An end of the fixed wrap 144 may be disposed to contact the orbiting head plate 133, and an end of the orbiting wrap 134 may be disposed to contact the fixed head plate 143. The fixed wrap 144 may disposed in a predetermined spiral shape, and a discharge hole 145, through which the compressed refrigerant may be discharged, may be defined in an approximately central portion of the fixed head plate 143. A suction hole (see reference numeral 146 of FIG. 5), through which the refrigerant within the suction space S may be suctioned, may be defined in a side surface of the fixed scroll 140. The refrigerant suctioned through the suction hole 146 may be introduced into the compression chamber defined by the orbiting wrap 134 and the fixed wrap 144.

In detail, the fixed wrap 144 and the orbiting wrap 134 may define a plurality of compression chambers. Each of the plurality of compression chambers may be reduced in volume while revolving and moving toward the discharge hole 145 to compress the refrigerant. Thus, the compression chamber, which is adjacent to the suction hole 146, of the plurality of compression chambers may be minimized in pressure, and the compression chamber that communicates with the discharge hole 145 may be maximized in pressure. Also, the compression chamber between the above-described compression chambers may have an intermediate pressure that corresponds to a pressure between a suction pressure of the suction hole 146 and a discharge pressure of the discharge hole 145. The intermediate pressure may be applied to a back pressure chamber BP, which will be described hereinbelow, to press the fixed scroll 140 toward the orbiting scroll 130.

An intermediate pressure discharge hole 147 that transfers the refrigerant of the compression chamber having the intermediate pressure to the back pressure chamber BP may be defined in the fixed head plate 143 of the fixed scroll 140. That is, the intermediate pressure discharge hole 147 may be defined in one portion of the fixed scroll 140 so that the compression chamber that communicates with the intermediate pressure discharge hole 147 has a pressure greater than the suction pressure in the suction space S and less than the discharge pressure in the discharge space D. The intermediate pressure discharge hole 147 may pass through the fixed head plate 143 from a top surface to a bottom surface of the fixed head plate 143.

A back pressure chamber assembly 150 and 160 disposed above the fixed scroll 140 to define the back pressure chamber may be disposed on the fixed scroll 140. The back pressure chamber assembly 150 and 160 may include a back pressure plate 150, and a floating plate 160 separably coupled to the back pressure plate 150. The back pressure plate 150 may be fixed to an upper portion of the fixed head plate 143 of the fixed scroll 140.

The back pressure plate 150 may have an approximately annular shape with a hollow and include a support 152 that contacts the fixed head plate 143 of the fixed scroll 140. An intermediate pressure suction hole 153 that communicates with the intermediate pressure discharge hole 147 may be defined in the support 152. The intermediate pressure suction hole 153 may pass through the support 152 from a top surface to a bottom surface of the support 152.

A second coupling hole 154 that communicates with the first coupling hole 148 defined in the fixed head plate 143 of the fixed scroll 140 may be defined in the support 152. The first coupling hole 148 and the second coupling hole 154 may be coupled to each other by a coupling member (not shown).

The back pressure plate 150 may include a plurality of walls 158 and 159 that extend in an upward direction from the support 152. The plurality of walls 158 and 159 may include a first wall 158 that extends in the upward direction from an inner circumferential surface of the support 152, and a second wall 159 that extends in the upward direction from an outer circumferential surface of the support 152. Each of the first and second walls 158 and 159 may have an approximately cylindrical shape.

The first and second walls 158 and 159 together with the support 152 may define a space. A portion of the space may be a back pressure chamber BP.

The first wall 158 may include a top surface 158*a* that defines a top surface of the first wall 158. The first wall 158 may include at least one intermediate discharge hole 158*b* that communicates with the discharge hole 145 of the fixed head plate 143 to discharge the refrigerant discharged from the discharge hole 145 toward the discharge cover 105. The intermediate discharge hole 158*b* may pass from a bottom surface of the first wall 158 to the top surface 158*a*. An inner space of the first wall 158 having a cylindrical shape may communicate with the discharge hole 145 to define a portion of a discharge passage through which the discharged refrigerant may flow into the discharge space D.

A discharge valve 108 having an approximately circular pillar shape may be disposed inside the first wall 158. The discharge valve 108 may be disposed above the discharge hole 145 and have a size sufficient to completely cover the discharge hole 145. For example, the discharge valve 108 may have an outer diameter greater than a diameter of the discharge hole 145. Thus, when the discharge valve 108 contacts the fixed head plate 143 of the fixed scroll 140, the discharge valve 108 may close the discharge hole 145.

The discharge valve 108 may be movable in upward or downward directions according to a variation in pressure applied to the discharge valve 108. Also, the inner circumferential surface of the first wall 158 may define a moving guide 158*c* that guides movement of the discharge valve 108.

A discharge pressure apply hole 158*d* may be defined in the top surface 158*a* of the first wall 158. The discharge pressure apply hole 158*d* may communicate with the discharge hole 105*a*. The discharge pressure apply hole 158*d* may be defined in an approximately central portion of the top surface 158*a*, and the plurality of intermediate discharge holes 158*b* may be disposed to surround the discharge pressure apply hole 158*d*.

For example, when operation of the scroll compressor 100 is stopped, if the refrigerant flows backward from the discharge space D toward the discharge hole 145, the pressure applied to the discharge pressure apply hole 158*d* may be greater than the discharge hole-side pressure. That is, the pressure may be applied downward to a top surface of the discharge valve 108, and thus, the discharge valve 108 may move downward to close the discharge hole 145.

On the other hand, if the scroll compressor 100 operates to compress the refrigerant in the compression chamber, when the discharge hole-side pressure is greater than the pressure in the discharge space D, an upward pressure may be applied to a bottom surface of the discharge valve 108, and thus, the discharge valve 108 may move upward to open the discharge hole 145. When the discharge hole 145 is opened, the refrigerant discharged from the discharge hole 145 may flow toward the discharge cover 105 via the intermediate discharge hole 158*b*, and then, may be discharged outside of the scroll compressor 100 through the discharge port 103 via the discharge hole 105*a*.

The back pressure plate 150 may further include a step 158*e* disposed inside a portion at which the first wall 158 and the support 152 are connected to each other. The refrigerant discharged from the discharge hole 145 may reach a space defined by the step 158*e* and then flow to the intermediate discharge hole 158*b*.

The second wall 159 may be spaced a predetermined distance from the first wall 158 to surround the first wall 158. The back pressure plate 150 may have a space having an approximately U-shaped cross-section formed by the first wall 158, the second wall 159, and the support 152. The floating plate 160 may be accommodated in the space. The space, which may be covered by the floating plate 160, may form the back pressure chamber BP. On the other hand, the first and second walls 158 and 159 of the back pressure plate 150, the support 152, and the floating plate 160 may define the back pressure chamber BP.

The floating plate 160 may include an inner circumferential surface that faces an outer circumferential surface of the first wall 158, and an outer circumferential surface that faces an inner circumferential surface of the second wall 159. That is, the inner circumferential surface of the floating plate 160 may contact the outer circumferential surface of the first wall 158, and the outer circumferential surface of the floating plate 160 may contact the inner circumferential surface of the second wall 159.

The floating plate 160 may have an inner diameter equal to or greater than an outer diameter of the first wall 158 of the back pressure plate 150. The floating plate 160 may have an outer diameter equal to or less than an inner diameter of the second wall 159 of the back pressure plate 150.

A sealing member 159*a* to prevent the refrigerant within the back pressure chamber BP from leaking may be disposed on at least one of the first and second walls 158 and 159 and the floating plate 160. The sealing member 159*a* may prevent the refrigerant from leaking between the inner circumferential surface of the second wall 159 and the outer circumferential surface of the floating plate 160. The sealing member may be disposed on the first wall 158 or the inner circumferential surface of the floating plate 160.

A rib 164 that extends in an upward direction may be disposed on a top surface of the floating plate 160. For example, the rib 164 may extend in the upward direction from the inner circumferential surface of the floating plate 160.

When the floating plate 160 ascends, the rib 164 may contact a bottom surface of the discharge cover 105. When the rib 164 contacts the discharge cover 105, communication between the suction space S and the discharge space D may be blocked. On the other hand, when the rib 164 is spaced apart from the bottom surface of the discharge cover 105, that is, when the rib 164 moves in a direction away from the discharge cover 105, the suction space S and the discharge space D may communicate with each other.

In detail, while the scroll compressor 100 operates, the floating plate 160 may move upward to allow the rib 164 to contact the bottom surface of the discharge cover 105. Thus, the refrigerant discharged from the discharge hole 145 to pass through the intermediate discharge hole 158*b* may not leak into the suction space S, but rather, may be discharged into the discharge space D.

On the other hand, when the scroll compressor 100 is stopped, the floating plate 160 may move downward to allow the rib 164 to be spaced apart from the bottom surface of the discharge cover 105. Thus, the discharged refrigerant disposed at the discharge cover-side may flow toward the suction space S through the space between the rib 164 and the discharge cover 105. Also, when the scroll compressor 100 is stopped, the floating plate 160 may move upward to allow the rib 164 to be spaced apart from the bottom surface of the discharge cover 105.

Figure 5:
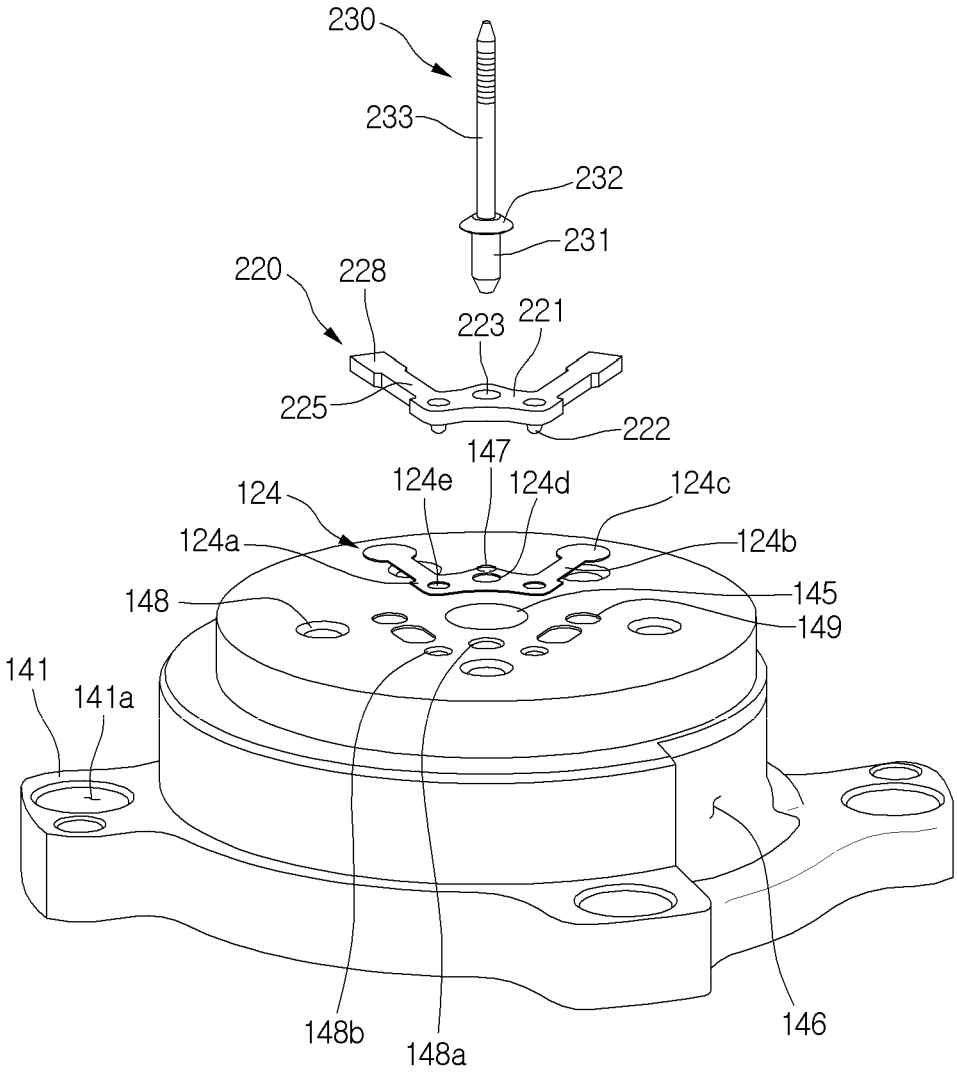
FIG. 5 is a perspective view of a fixed scroll according to an embodiment.
Figure 6:
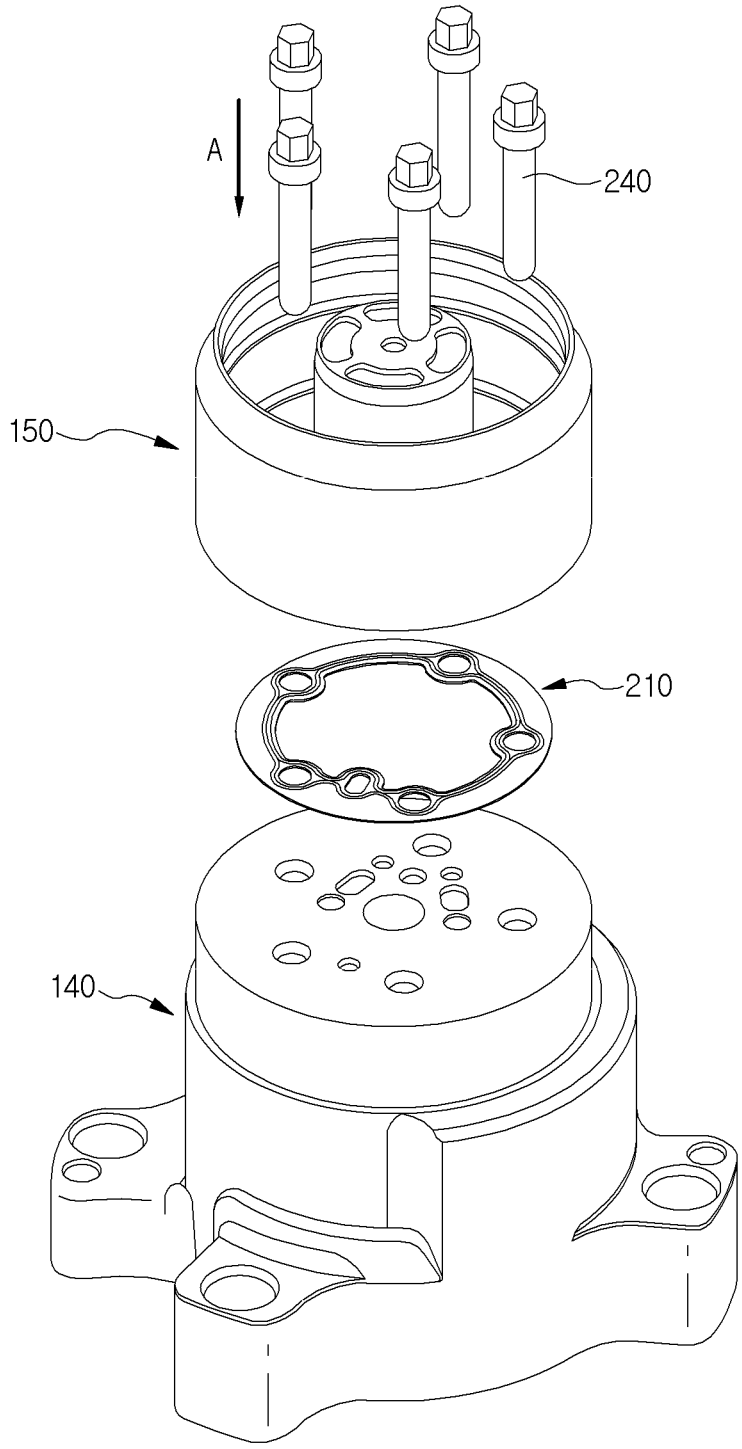
FIG. 6 is a perspective view of the fixed scroll, a gasket, and the back pressure plate according to an embodiment.
Figure 7:
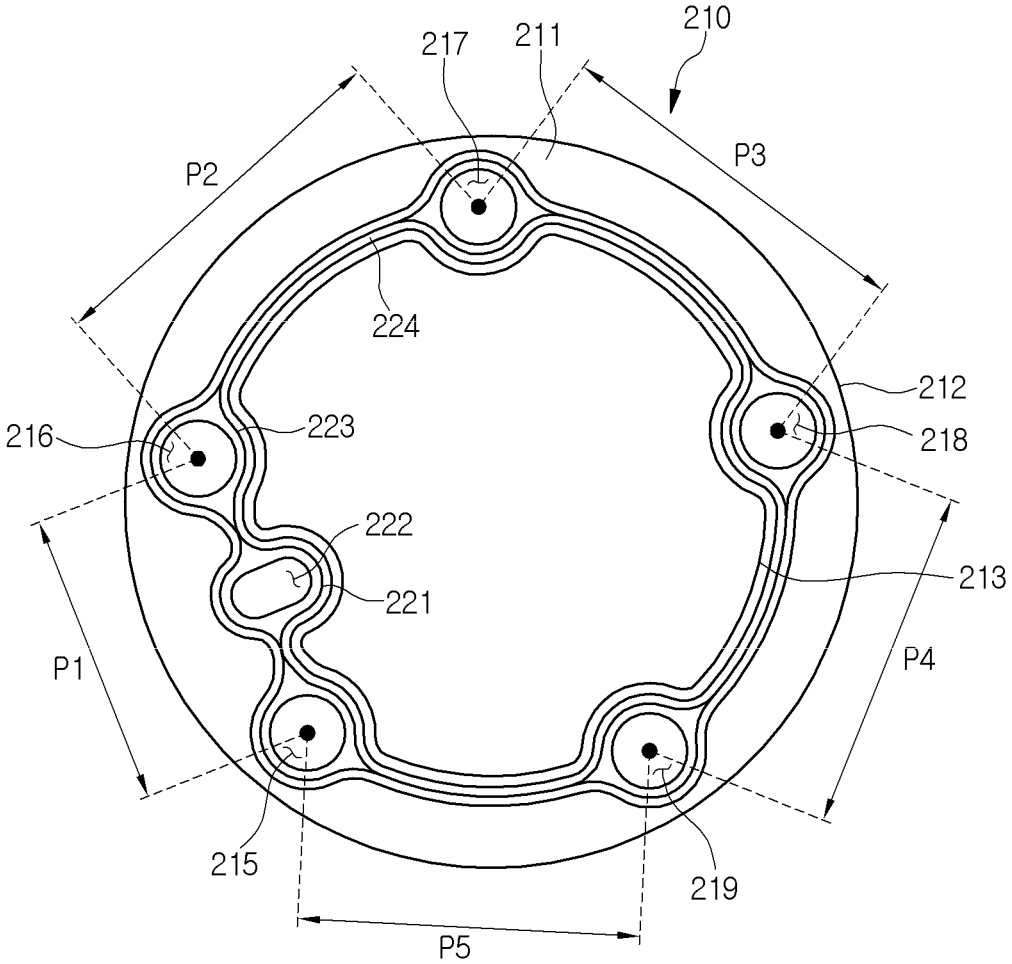
FIG. 7 is a plan view of the gasket according to an embodiment.
Figure 8:
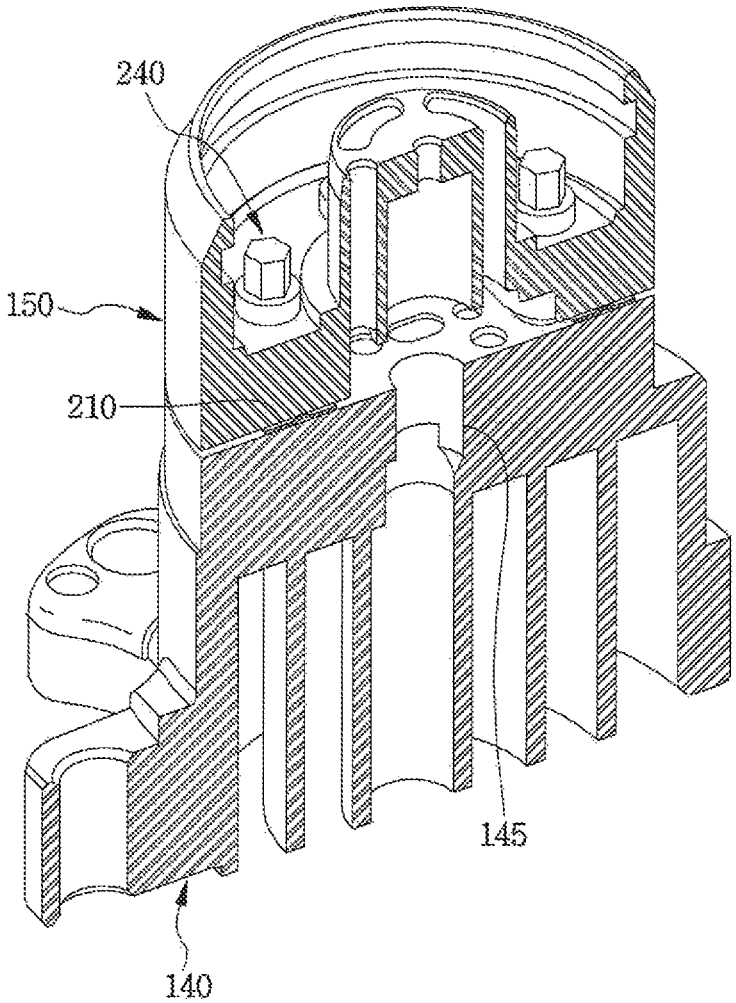
FIG. 8 is a cross-sectional view illustrating a state in which the back pressure plate is coupled to the fixed scroll according to an embodiment.

FIG. 5 is a perspective view of a fixed scroll according to an embodiment. FIG. 6 is a perspective view of the fixed scroll, a gasket, and a back pressure plate according to an embodiment. FIG. 7 is a plan view of the gasket according to an embodiment.

Referring to FIGS. 2, 5 to 8, the fixed scroll 140 according to an embodiment may include at least one bypass hole 149 defined in one side of the discharge hole 145. Although two bypass holes 149 are shown in FIG. 5, embodiments are not limited to the number of bypass holes 149. Each bypass holes 149 may pass through the fixed head plate 143 to extend up to the compression chamber defined by the fixed wrap 144 and the orbiting wrap 134.

The bypass hole(s) 149 may be defined in different positions according to operation conditions. For example, the bypass hole 149 may communicate with the compression chamber having a pressure greater by about 1.5 times than the suction pressure. Also, the compression chamber that communicates with the bypass hole 149 may have a pressure greater than the pressure of the compression chamber that communicates with the intermediate pressure discharge hole 147.

The scroll compressor 100 may further include a bypass valve 124 that opens and closes the bypass hole(s) 149, a stopper 220 that restricts a moving distance of the bypass valve 124 when the bypass valve 124 opens the bypass hole(s) 149, and a coupling member 230 that couples the bypass valve 124 and the stopper 220 to the fixed scroll 140 at the same time. In detail, the bypass valve 124 may include a valve support 124*a* fixed to the fixed head plate 143 of the fixed scroll 140 by the coupling member 230. The bypass valve 124 may further include at least one connection portion 124*b* that extends from the valve support 124*a*, and at least one valve body 124*c* disposed on or at a side of the connection portion 124*b*. Each of the at least one connection portion 124*b* and the at least one valve body 124*c* may be provided in a same number as a number of the bypass hole(s) 149. For example, FIG. 5 illustrates the bypass valve 124 including two connection portions 124*b* and two valve bodies 124*c*.

The valve body 124*c* may be maintained in contact with the top surface of the fixed head plate 143 and have a size sufficient to cover the bypass hole 149. Further, the valve body 124*c* may be moved by a pressure of the refrigerant flowing along the bypass hole 149 to open the bypass hole 149. Thus, the connection portion 124*b* may have a size less than a diameter of the valve body 124*c* so that the valve body 124*c* may smoothly move.

When the bypass valve 124 opens the bypass hole 149, the refrigerant of the compression chamber that communicates with the bypass hole 149 may flow into a space between the fixed scroll 140 and the back pressure plate 150 through the bypass hole 149 to bypass the discharge hole 145. The bypassed refrigerant may flow toward the discharge hole 105*a* of the discharge cover 105 via the intermediate discharge hole 158*b*.

The stopper 220 may be disposed above the bypass valve 124. The stopper 220 may have a shape corresponding to a shape of the bypass valve 124. The bypass valve 124 may be elastically deformed by the refrigerant pressure. As the stopper 220 restricts movement of the bypass valve 124, the stopper 220 may have a thickness greater than a thickness of the bypass valve 124.

The stopper 220 may include a stopper support 221 that contacts the valve support 124*a*. The stopper 220 may further include at least one connection portion 225 that extends from the stopper support 221, and at least one stopper body 228 disposed on or at one side of the connection portion 225. Each of the at least one connection portion 225 of the at least one stopper 220 and the at least one stopper body 228 may be provided in a same number as a number of the connection portions 124*b* of the bypass valve 124 and the valve body 124*c*.

Each connection portion 225 of the stopper 220 may be inclined in an upward direction away from the stopper support 221. Thus, the valve body 124*c* may contact a top surface of the fixed head plate 143, and the stopper body 228 may be spaced apart from a top surface of the valve body 124*c* in a state in which the bypass valve 124 and the stopper 220 are coupled to the fixed head plate 143 by the coupling member 230. When the valve body 124*c* is lifted upward by the refrigerant flowing through the bypass hole 149, the top surface of the valve body 124*c* may contact the stopper body 228, and thus, the valve body 124*c* may be stopped.

Coupling holes 223 and 124*d*, to which the coupling member 230 may be coupled, may be defined in the stopper support 221 and the bypass valve 124. A coupling groove 148*a*, to which the coupling member 230 may be coupled, may be defined in the fixed head plate 143.

At least one guide protrusion 222 to maintain an arranged state of the coupling holes 223 and 124*d* and the coupling groove 148*a* before the coupling member 230 is coupled to each of the coupling holes 223 and 124*d* and the coupling groove 148*a* may be disposed on the stopper support 221. At least one protrusion through-hole 124*e*, through which the guide protrusion 222 may pass, may be defined in the valve support 221. At least one protrusion accommodation groove 148*b* that accommodates the guide protrusion 222 may be defined in the fixed head plate 143. Thus, when the guide protrusion 222 of the stopper 220 is accommodated into the protrusion accommodation groove 148*b* in a state in which the guide protrusion 222 passes through the protrusion through-hole 124*e* of the bypass valve 124, the stopper support 221, the bypass valve 124, and each of the coupling holes 223 and 124*d* and the coupling groove 18*a* of the fixed head plate 143 may be aligned with each other.

The stopper 220 may include a plurality of the guide protrusion 222, the bypass valve 124 may include a plurality of the through-hole 124*e*, and the fixed scroll 140 may include a plurality of the protrusion accommodation groove 148*b*, so that the stopper support 221, the bypass valve 124, and the coupling holes 223 and 124*d* and coupling groove 148*a* of the fixed head plate 143 may be more accurately aligned with each other. In this case, the coupling groove 223 may be disposed between the plurality of guide protrusions 222 of the stopper 220. Also, the coupling groove 124*d* may be disposed between the plurality of through-holes 124*e* of the bypass valve 124, and the coupling groove 148*a* may be disposed between the plurality of protrusion accommodation grooves 148*b* of the fixed head plate 143.

The coupling member 230 may be a rivet, for example. The coupling member 230 may include a coupling body 231 coupled to the stopper support 221, the bypass valve 124, and the coupling holes 223 and 124*d* and the coupling groove 148*a* of the fixed head plate 143, a head 232 disposed on the coupling body 231 to contact a top surface of the stopper support 221, and a separation portion 233 that passes through the head 232, disposed inside the coupling body 231, and being separable from the coupling body 231. When the separation portion 233 is pulled upward in FIG. 5, the separation portion 233 may be separated from the coupling body 231.

According to this embodiment, a configuration and coupling method of the coupling member 230 may be realized through well-known technology, and thus, detailed description thereof has been omitted.

The intermediate pressure discharge hole 147 of the fixed scroll 140 and the intermediate pressure suction hole 153 of the back pressure plate 150 may be disposed to be aligned with each other. The refrigerant discharged from the intermediate pressure discharge hole 147 may be introduced into the back pressure chamber BP via the intermediate pressure suction hole 153. The intermediate pressure discharge hole 147 and the intermediate pressure suction hole 153 may be referred to as a "bypass passage" in that the refrigerant of the back pressure chamber BP may be bypassed to the compression chamber through the intermediate pressure discharge hole 147 and the intermediate pressure suction hole 153.

The scroll compressor 100 may further include a gasket 210 disposed between the fixed scroll 140 and the back pressure plate 150. The gasket 210 may be seated on a top surface of the fixed head plate 143 to contact a bottom surface of the back pressure plate 150. The back pressure plate 150 and the gasket 210 may be coupled to the fixed head plate 143 of the fixed scroll 140 at the same time by at least one coupling member 240.

The gasket 210 may be formed by applying a material having elasticity to steel. The material having elasticity may be rubber or Teflon, for example.

In this embodiment, as the gasket is coated with the elastic material, the gasket 210 may be elastically deformed when the back pressure plate 150 and the fixed scroll 140 are coupled to each other. Thus, a contact area between the gasket 210 and the back pressure plate 150, and a contact area between the gasket 210 and the fixed scroll 140 may increase to improve sealing performance.

The gasket 210 may block communication between the back pressure chamber BP and the suction space S, and communication between the back pressure chamber BP and the discharge space D. That is, in this embodiment, one gasket 210 may block communication of three spaces. The gasket 210 may prevent the refrigerant of the back pressure chamber BP from leaking into the suction space S, prevent the refrigerant of the discharge space D or the discharge hole 145 from leaking into the back pressure chamber BP, and prevent the refrigerant of the discharge space D or the discharge hole 145 from leaking into the suction space S.

The gasket 210 may include a gasket body 211 having a plate shape. The gasket body 211 may include an outer circumferential surface 212 and an inner circumferential surface 213. For example, the outer circumferential surface 212 of the gasket body 211 may have a circular shape, and the inner circumferential surface 213 may have a non-circular shape. That is, a distance between the outer circumferential surface 212 and the inner circumferential surface 213 of the gasket body 211 may vary in a circumferential direction. For example, the outer circumferential surface 212 of the gasket body 211 may have a diameter equal to or less than an outer diameter of the back pressure plate 150.

The gasket body 211 may include one or more coupling holes 215 to 219, through which coupling member 240 may pass. For example, FIG. 6 illustrates a plurality of coupling members 240, and FIG. 7 illustrates a plurality of coupling holes 215 to 219.

Each coupling member 240 may pass through the second coupling hole(s) 154 of the back pressure plate 150 and the coupling holes 215 to 219 of the gasket 210, and then may be coupled to the first coupling hole(s) 148 of the fixed scroll 140. In this embodiment, a number of coupling member 240 may be equal to a number of each of the first coupling hole(s) 148 of the fixed scroll 140, the second coupling hole(s) 154 of the back pressure plate 150, and the coupling holes 215 to 219 of the gasket 210.

The one or more coupling holes 215 to 219 may include a first coupling hole 215, a second coupling hole 216, a third coupling hole 217, a fourth coupling hole 218, and a fifth coupling hole 219. However, the number of coupling holes is not limited thereto. At least four coupling holes may be provided so that a coupling force between the back pressure plate 150 and the fixed scroll 140 may be maintained, and a sealing force by the gasket 210 may be maintained.

In this embodiment, if a distance between two coupling holes, which are adjacent to each other, of the plurality of coupling holes 215 to 219 is defined as a pitch, the plurality of coupling holes 215 to 219 may be defined in the gasket 210 so that at least three pitches different from each other may be provided. Further, in this embodiment, a distance between the two coupling holes adjacent to each other may represent a distance between centers of the two coupling holes.

For example, a distance between the first coupling hole 215 and the second coupling hole 216 may be defined as a first pitch P1, a distance between the second coupling hole 216 and the third coupling hole 217 may be defined as a second pitch P2, a distance between the third coupling hole 217 and the fourth coupling hole 218 may be defined as a third pitch P3, a distance between the fourth coupling hole 218 and the fifth coupling hole 219 may be defined as a fourth pitch P4, and a distance between the fifth coupling hole 219 and the first coupling hole 215 may be defined as a fifth pitch P5. The first pitch P1 may be shortest, and at least one pitch of the second to fifth pitches P2 to P5 may be longer than the first pitch P1 and shorter than the other pitches.

The plurality of first coupling holes 148 of the fixed scroll 140 and the plurality of second coupling holes 154 of the back pressure plate 150 may be disposed with a same configuration as an arrangement of the plurality of coupling holes 215 to 219 of the gasket 210. Thus, according to this embodiment, as the plurality of coupling holes 215 to 219 may be defined in the gasket 210 so that at least three pitches are provided, the gasket 210 may be accurately disposed in only one direction or orientation.

The gasket 210 may include an intermediate pressure communication hole 222 that communicates with the intermediate pressure discharge hole 147 and the intermediate pressure suction hole 153. That is, the intermediate pressure communication hole 222 may be disposed between the intermediate pressure discharge hole 147 and the intermediate pressure suction hole 153 to allow the intermediate pressure discharge hole 147 to communicate with the intermediate pressure suction hole 153.

The intermediate pressure communication hole 222 may be disposed between the first coupling hole 215 and the second coupling hole 216, which has the shortest pitch therebetween, of the plurality of coupling holes 215 to 219. The plurality of coupling holes 215 to 219 and the intermediate pressure communication hole 222 may be disposed between the outer circumferential surface 212 and the inner circumferential surface 213 of the gasket body 211.

According to this embodiment, the coupling member 240 may be coupled to each of the plurality of coupling holes 215 to 219. A coupling force may be largest between the first coupling hole 215 and the second coupling hole 216, which have the shortest pitch therebetween, of the plurality of coupling holes 215 to 219. The largest coupling force between the two coupling holes 215 and 216 may represent an increase in adhesion force between a portion of the gasket 210 disposed between the coupling holes 215 and 216 and the back pressure plate 150 and between a portion of the gasket 210 and the fixed scroll 140.

Thus, according to this embodiment, as the intermediate pressure communication hole 222 may be disposed between the first coupling hole 215 and the second coupling hole 216, which has the shortest pitch therebetween, of the plurality of coupling holes 215 to 219, leakage of refrigerant of the back pressure chamber BP into the suction space S through a gap between the back pressure plate 150 and the fixed scroll 140 may be effectively prevented, and also, leakage of the refrigerant of the discharge space D or the discharge hole 145 into the back pressure chamber BP through a gap between the back pressure plate 150 and the fixed scroll 140 may be effectively prevented. The gasket 210 may further include embossments 221, 223, and 224 to improve sealing performance.

The embossments 221, 223, and 224 may be formed by foaming a portion of the gasket body 211. Each of the embossments 221, 223, and 224 may protrude from the gasket body 211 in a second direction opposite to a first direction (direction A in FIG. 6) in which the coupling member 240 is coupled to the fixed scroll 140. Thus, in a state in which the coupling member 240 couples the back pressure plate 150 and the gasket 210 to the fixed scroll 140, the embossments 221, 223, and 224 may contact the bottom surface of the back pressure plate 150, and the bottom surface of the gasket 210 may contact the fixed head plate 143 of the fixed scroll 140.

As each of the embossments 221, 223, and 224 protrudes from the gasket body 211 in the second direction opposite to the first direction in which the coupling member 240 is coupled, while the coupling member 240 is coupled to the fixed scroll 140, the bottom surface of the back pressure plate 150 may approach the fixed scroll 140 while pressing the embossments 221, 223, and 224. Thus, an adhesion force of the bottom surface of the back pressure plate 150 may increase.

The embossments 221, 223, and 224 may include a first embossment 221, a plurality of second embossments 223, and a plurality of third embossments 224. The first embossment 221 may communicate with the intermediate pressure communication hole 222. The first embossment 221 may have an area greater than an area of the intermediate pressure communication hole 222.

The plurality of coupling holes 215 to 219 may be defined in the plurality of second embossments 223, respectively. Each of the plurality of second embossments 223 may have an area greater than an area of each of the plurality of coupling holes 215 to 219.

A first portion of the plurality of third embossments 224 may connect two second embossments 223 adjacent to each other. A second portion of the plurality of third embossments 224 may connect two second embossments 223 having the first and second coupling holes 215 and 216 to the first embossment 221. Thus, the first to third embossments 221, 223, and 224 may be disposed on the gasket 210 in a closed loop shape.

According to this embodiment, even though the gasket has a non-uniform thickness by due the first to third embossments 221, 223, and 224, the gasket 210 may be effectively closely attached to the back pressure plate 150 and the fixed scroll 140. Also, in a state in which the coupling member 240 couples the back pressure plate 150 and the gasket 210 to the fixed scroll 140, adhesion forces between the embossments 221, 223, and 224 and the back pressure plate 150 may increase to effectively prevent the refrigerant from leaking through the portions in which the coupling holes 215 to 219 are defined and the portion in which the intermediate pressure communication hole 222 is defined. Also, in a state in which the embossments 221, 223, and 224 are disposed on the gasket 210, when the coupling member 240 couples the back pressure plate 150 and the gasket 210 to the fixed scroll 140, an adhesion force between a peripheral portion of the portion of the gasket 210 on which the embossments 221, 223, and 224 are disposed and the fixed scroll 140 may increase. According to this embodiment, as the coupling holes 215 to 219 are respectively defined in the plurality of second embossments 223, even though the peripheral portion of the first coupling hole 148 of the fixed scroll 140 is damaged or cracked while the coupling member 240 is coupled to the fixed scroll 140, refrigerant leakage may be prevented by the gasket 210.

As another example, the first embossment 221 may be disposed to surround the intermediate pressure communication hole 221 on the gasket 210, and the plurality of second embossments 223 may be, respectively, disposed to surround the coupling holes 215 to 219. Also, the first portion of each third embossment 224 may connect the two second embossments 223 adjacent to each other, and the second portion of the third embossment 223 may connect the two second embossments 223 in which the first and second coupling holes 215 and 216 are defined to the first embossment 221.

To improve the sealing force through the embossments 221, 223, and 224, the embossments 221, 223, and 224 may be disposed between the outer circumferential surface 212 and the inner circumferential surface 213 of the gasket body 211. That is, the embossments 221, 223, and 224 may be spaced apart from the outer and inner circumferential surfaces 212 and 213 of the gasket body 211.

Further, a portion of the inner circumferential surface 213 of the gasket body 211 may be disposed on a line that connects a center, that is, the same as a center of the discharge hole 145 of the fixed scroll 140, to a center of the intermediate pressure communication hole 222. Furthermore, a distance between the outer circumferential surface 212 and the inner circumferential surface 213 of the gasket body 211 may be longest at the portion in which the intermediate pressure communication hole 222 is defined.

According to this embodiment, as communication between the back pressure chamber BP and the suction space S, between the back pressure chamber BP and the discharge space D, and between the suction space S and the discharge space D is blocked, the sealing structure may be simplified. Further, in a state in which the gasket 210 is seated on the fixed scroll 140, and the back pressure plate 150 is seated on the gasket 210, as the gasket 210 and the back pressure plate 150 are coupled to the fixed scroll 140 at once using the coupling member 240, the assembly process may be simplified. Furthermore, as a groove to seat the gasket 210 is not defined in the fixed scroll 140 or the back pressure plate 150, refrigerant leakage due to a non-uniform depth of a groove, which occurs when the groove is processed, may be prevented.

Figure 9:
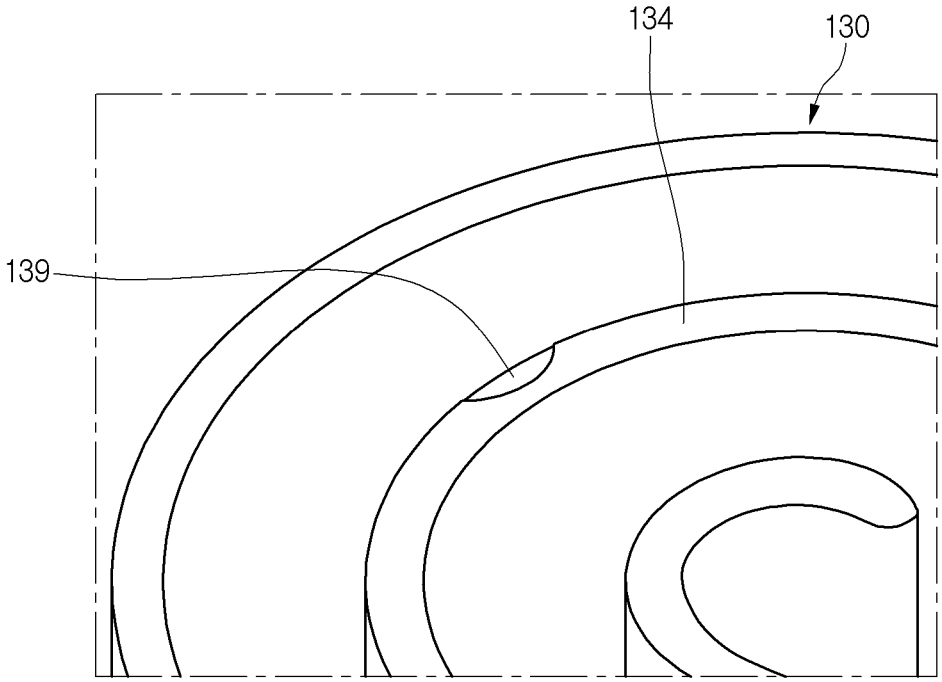
FIG. 9 is a partial view of an orbiting scroll according to an embodiment.
Figure 10:
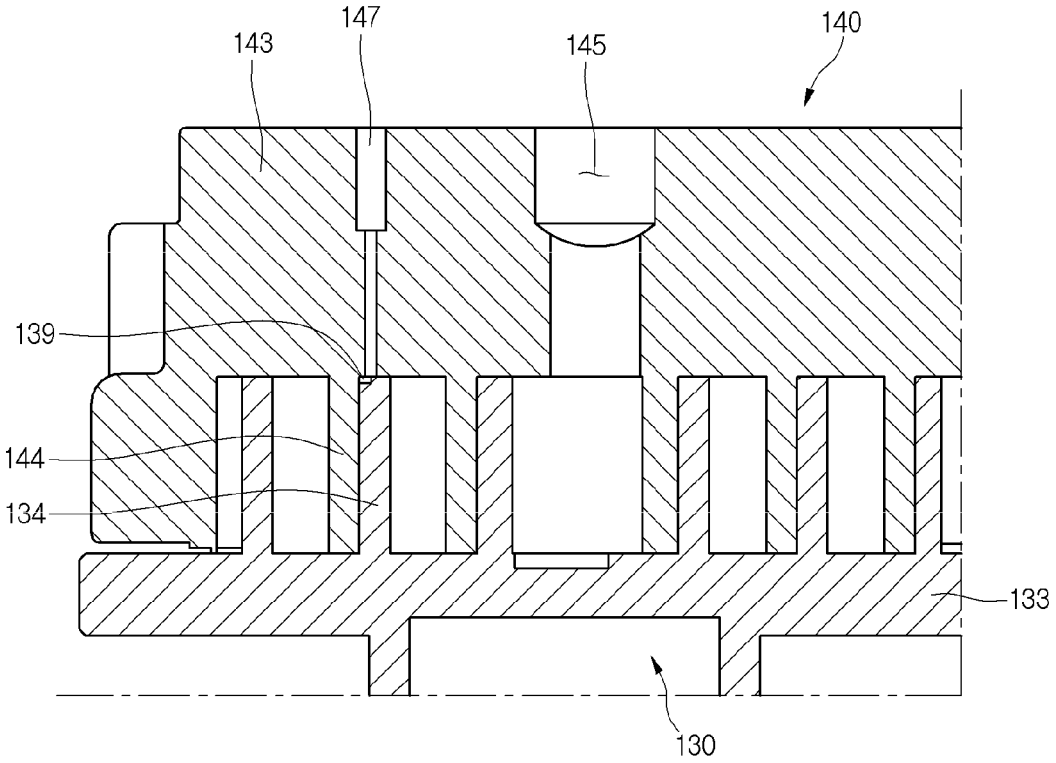
FIG. 10 is a cross-sectional view illustrating a state in which the fixed scroll and the orbiting scroll are coupled to each other according to an embodiment.
Figure 11A:
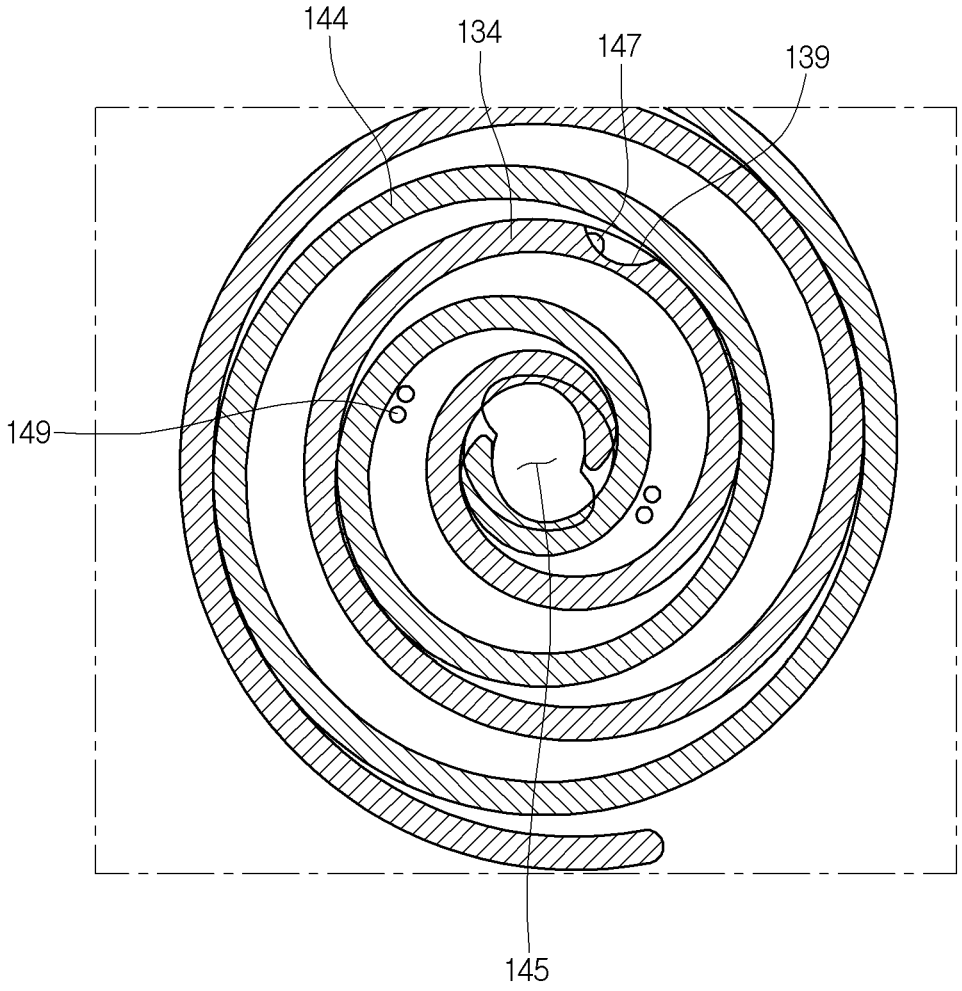
FIGS. 11A to 11C are views illustrating relative positions of an intermediate pressure discharge hole of the fixed scroll and a discharge guide of the orbiting scroll while the orbiting scroll revolves.
Figure 11B:
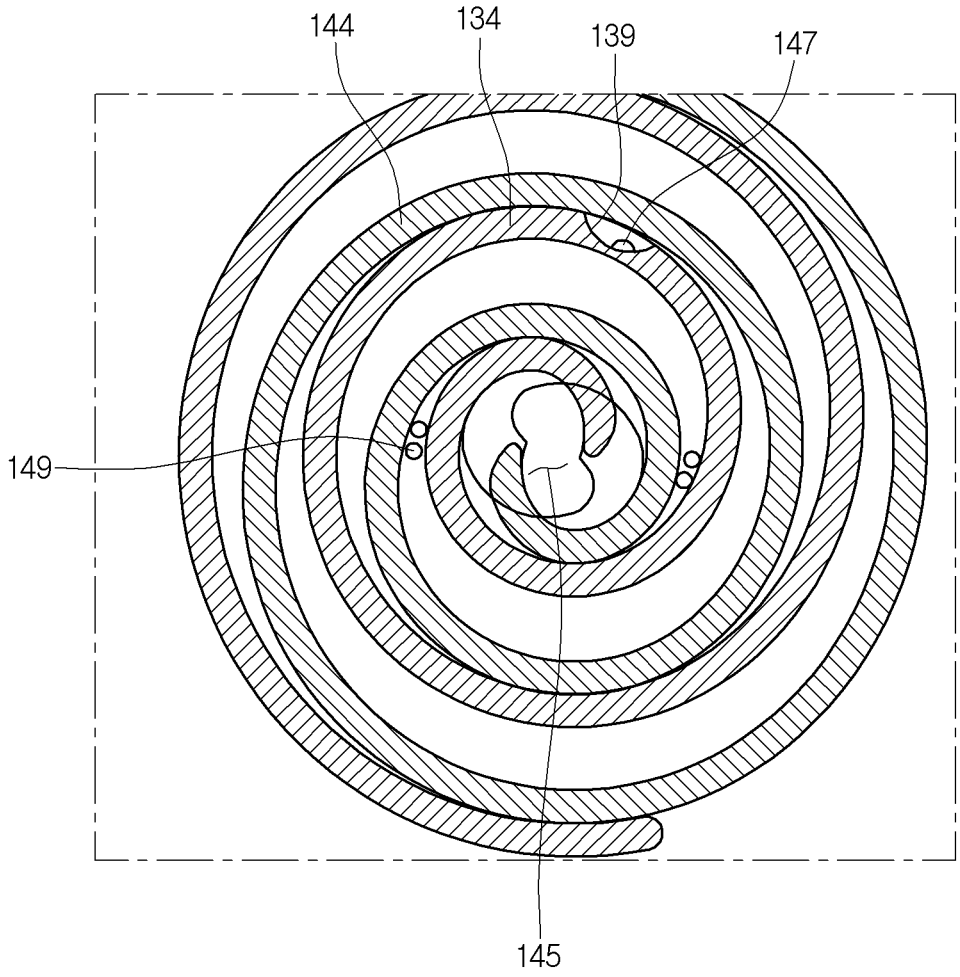
Figure 11C:
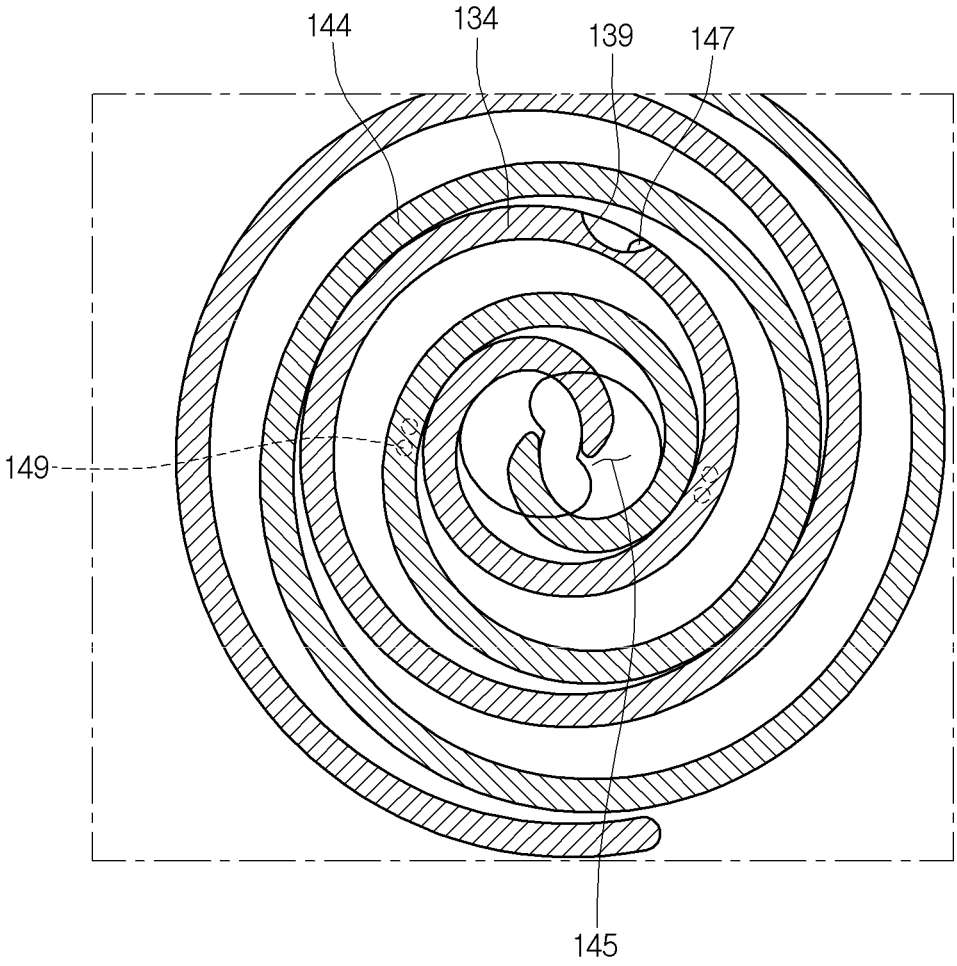

FIG. 9 is a partial view of an orbiting scroll according to an embodiment, FIG. 10 is a cross-sectional view illustrating a state in which the fixed scroll and the orbiting scroll are coupled to each other according to an embodiment. FIGS. 11A to 11C are views illustrating relative positions of an intermediate pressure discharge hole of the fixed scroll and a discharge guide of the orbiting scroll while the orbiting scroll revolves.

Referring to FIGS. 9 and 10, the orbiting scroll 130 may include a discharge guide 139 to guide the refrigerant flowing into the intermediate pressure discharge hole 147 so that the refrigerant may be introduced into a space (region) having a pressure less than a pressure of the back pressure chamber BP. In detail, when operation of the scroll compressor 100 is stopped, the compression chamber defined by the orbiting wrap 134 and the fixed wrap 144 vanishes, and thus, the refrigerant flows into the space (region) between the orbiting wrap 134 and the fixed wrap 144. The space (region) may have a pressure less than a pressure of the back pressure chamber BP. The space (region) may be referred to as a "wrap space".

The discharge guide 139 may be recessed from an end surface of the orbiting wrap 134 of the orbiting scroll 130. Thus, the discharge guide 139 may be referred to as a "recess". The end surface of the orbiting wrap 134 may be understood as a surface of the orbiting wrap 134 that faces the fixed head plate 143 of the fixed scroll 140 or a surface of the orbiting wrap 134 that contacts the fixed head plate 143.

A width of the end surface of the orbiting wrap 134, that is, a thickness of the orbiting wrap 134 may be greater than a width of the intermediate pressure discharge hole 147. Also, the discharge guide 139 may be recessed from the end surface of the orbiting wrap 134 by a preset or predetermined width and depth.

While the orbiting scroll 130 revolves, the orbiting wrap 134 may be disposed directly below the intermediate pressure discharge hole 147 or be disposed to be spaced horizontally from a lower end of the intermediate pressure discharge hole 147 to open the intermediate pressure discharge hole 147. If the discharge guide 139 is not provided, when the orbiting wrap 134 is disposed directly below the intermediate pressure discharge hole 147 (in FIG. 10), the orbiting wrap 134 may cover the intermediate pressure discharge hole 147. On the other hand, when the orbiting wrap 134 moves horizontally by a predetermined distance, at least a portion of the intermediate pressure discharge hole 147 may be opened. Also, while the scroll compressor 100 operates, when the intermediate pressure discharge hole 147 is opened, the intermediate pressure refrigerant of the compression chamber may be introduced into the back pressure chamber BP through the intermediate pressure discharge hole 147.

On the other hand, in a state in which the scroll compressor 100 is stopped, when the orbiting wrap 134 is disposed directly below the intermediate pressure discharge hole 147 to block the intermediate pressure discharge hole 147, the refrigerant of the back pressure chamber BP may not be introduced into the wrap space through the intermediate pressure discharge hole 147. As a result, an equilibrium pressure may not be maintained, and thus, quick re-operation of the compressor may be limited.

Thus, according to this embodiment, the discharge guide 139 may be disposed in the orbiting wrap 134 to prevent the intermediate pressure discharge hole 147 from being completely covered or shielded, and thus, even though the orbiting wrap 134 is disposed directly below the intermediate pressure discharge hole 147, the intermediate pressure discharge hole 147 and the compression chamber (when the compressor operates) or the intermediate pressure discharge hole 147 and the wrap space (when the compressor stops) may communicate with each other.

Referring to FIGS. 11A to 11C, the plurality of compression chambers is formed while the orbiting scroll 130 revolves, and then, the plurality of compression chambers moves toward the discharge hole 145 while being reduced in volume. With this process, the orbiting wrap 134 of the orbiting scroll 130 may selectively open the bypass hole 149. For example, when the orbiting wrap 134 opens the bypass hole 149, the refrigerant of the compression chamber that communicates with the bypass hole 149 may flow into the bypass hole 149 to bypass the discharge hole 145. On the other hand, when the orbiting wrap 134 covers the bypass hole 149, flow of the refrigerant of the compression chamber into the bypass hole 149 may be limited.

The back pressure chamber BP and the intermediate pressure discharge hole 147 may always communicate with the compression chamber via the discharge guide 139. That is, the discharge guide 139 may be disposed on an end of the orbiting wrap 134 at a position at which the back pressure chamber BP and the intermediate pressure discharge hole 147 always communicate with the compression chamber.

In summary, even though the orbiting wrap 134 is disposed directly below the intermediate pressure discharge hole 147 while the orbiting wrap 134 revolves, the lower end of the intermediate pressure discharge hole 147 and the end surface of the orbiting wrap 134 may be spaced apart from each other by the recessed discharge guide 139. Thus, when the scroll compressor 100 operates, refrigerant of the compression chamber may be introduced into the back pressure chamber BP through the intermediate pressure discharge hole 147. Also, when the scroll compressor 100 is stopped, the refrigerant of the back pressure chamber BP may be introduced into the wrap space through the intermediate pressure discharge hole 147.

In detail, FIGS. 11A to 11C illustrate a state in which the orbiting wrap 134 is disposed directly below the intermediate pressure discharge hole 147 while the orbiting wrap 134 revolves, that is, the state in which the end surface of the orbiting wrap 134 is disposed to block the intermediate pressure discharge hole 147 if the discharge guide part 139 is not provided. Even though the orbiting wrap 134 is disposed as illustrated in FIGS. 11A to 11C, the intermediate pressure discharge hole 147 may communicate with the compression chamber by the discharge guide 139. Thus, the refrigerant of the back pressure chamber BP having an intermediate pressure Pm may be introduced into the wrap space between the orbiting wrap 134 and the fixed wrap 144 via the intermediate pressure discharge hole 147 and the discharge guide 139.

If the orbiting wrap 134 is disposed at a position not illustrated in FIGS. 11A to 11C, at least a portion of the intermediate pressure discharge hole 147 may be opened. That is, the orbiting wrap 134 may be in a state in which the orbiting wrap 134 moves horizontally to open the at least a portion of the lower end of the intermediate pressure discharge hole 147.

In the foregoing embodiment, although the gasket blocks communication between the back pressure chamber and the suction and discharge spaces, embodiments are not limited thereto. For example, this feature may be applied to different kinds of compressors in addition to the scroll compressor. The gasket may be disposed between a first member having a first hole and a second member having a second hole to form a communication hole that allows the first hole to communicate with the second hole, thereby preventing a fluid from leaking between the first and second members. In this case, the gasket may be coupled to the first or second member by the coupling member. Also, the gasket may have a same configuration as the above-described gasket.

Embodiments disclosed herein provide a scroll compressor.

Embodiments disclosed herein provide a scroll compressor that may include a casing including a rotational shaft; a discharge cover fixed of inside the casing to partition an inside of the casing into a suction space and a discharge space; a first scroll revolving by rotation of the rotational shaft; a second scroll that defines a plurality of compression chambers together with the first scroll, the second scroll having an intermediate pressure discharge hole that communicates with a compression chamber having an intermediate pressure of the plurality of compression chambers; a back pressure plate that defines a back pressure chamber that accommodates a refrigerant discharged from the intermediate pressure discharge hole; a floating plate movably disposed on or at a side of the back pressure plate to define the back pressure chamber together with the back pressure plate; and a gasket disposed between the back pressure plate and the second scroll and having an intermediate pressure communication hole that allows the intermediate pressure discharge hole to communicate with the intermediate pressure suction hole. The gasket may block communication between the back pressure chamber and the suction and discharge spaces.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising a casing comprising a rotational shaft;

a discharge cover fixed inside of the casing to partition an inside of the casing into a suction space and a discharge space;

a first scroll that is revolved by rotation of the rotational shaft;

a second scroll that defines a plurality of compression chambers together with the first scroll the second scroll having an intermediate pressure discharge hole that communicates with a compression chamber having an intermediate pressure of the plurality of compression chambers;

a back pressure plate that defines a back pressure chamber that accommodates a refrigerant discharged from the intermediate pressure discharge hole;

a floating plate movably disposed on the back pressure plate to define the back pressure chamber together with the back pressure plate and including an intermediate pressure suction hole;

a gasket disposed between the back pressure plate and the second scroll and having an intermediate pressure communication hole that allows the intermediate pressure discharge hole to communicate with the intermediate pressure suction hole, wherein the gasket blocks communication between the back pressure chamber and the suction and discharge spaces; and at least one coupling member to couple the back pressure plate and the gasket to the second scroll, wherein the gasket comprises a gasket body having an inner circumferential surface and an outer circumferential surface, wherein the intermediate pressure communication hole and at least one coupling hole, to which the at least one coupling member is coupled, are defined between the inner circumferential surface and the outer circumferential surface, and wherein the at least one coupling hole comprises a plurality of coupling holes defined in the gasket body, and when a distance between two coupling holes adjacent to each other of the plurality of coupling holes is defined as a pitch, the intermediate pressure communication hole is disposed between first and second coupling holes, which have a shortest pitch therebeween.

2. The scroll compressor according to claim 1, wherein the plurality of coupling holes is defined in the gasket body so that at least three pitches having lengths different from each other are provided.

3. The scroll compressor according to claim 1, wherein the gasket further comprises at least one embossment that protrudes from the gasket body, wherein the at least one coupling member is coupled to the second scroll in a first direction, and wherein the at least one embossment protrudes from the gasket body in a second direction opposite to the first direction.

4. The scroll compressor according to claim 3, wherein the at least one embossment contacts the back pressure plate.

5. The scroll compressor according to claim 1, wherein the gasket further comprises a plurality of embossments that protrudes from the gasket body, and wherein the plurality of the embossments comprises:

a first embossment in which the intermediate pressure communication hole is defined;

a plurality of second embossments in which the plurality of coupling holes is respectively defined; and a plurality of third embossments that connects two second embossments disposed adjacent to each other.

6. The scroll compressor according to claim 5, wherein a portion of the plurality of third embossments connects two second embossments in which the first and second coupling holes are respectively defined to the first embossment.

7. The scroll compressor according to claim 1, wherein the gasket further comprises a plurality of embossments that protrudes from the gasket body, and wherein the plurality of embossments comprises:

a first embossment that surrounds the intermediate pressure communication hole;

a plurality of second embossments, respectively, that surrounds the plurality of coupling holes; and a plurality of third embossments that connects two second embossments disposed adjacent to each other.

8. The scroll compressor according to claim 7, wherein a portion of the plurality of third embossments connects two second embossments in which the first and second coupling holes are respectively defined to the first embossment.

9. The scroll compressor according to claim 1, wherein the gasket further comprises at least one embossment that protrudes from the gasket body, and wherein the at least one embossment is spaced apart from the outer circumferential surface and the inner circumferential surface of the gasket body.

10. The scroll compressor according to claim 1, wherein a distance between the outer circumferential surface and the inner circumferential surface of the gasket body is longest at a portion in which the intermediate pressure communication hole is defined.

11. The scroll compressor according to claim 1, wherein the gasket is formed by applying a rubber or Teflon material to steel.

12. The scroll compressor according to claim 11, wherein when the back pressure plate and the second scroll are coupled to each other, the gasket is elastically deformed to have increased contact areas between the gasket and the back pressure plate and between the gasket and the second scroll to prevent the refrigerant of the back pressure chamber from leaking into the suction and discharge spaces.

13. The scroll compressor according to claim 1, wherein the first scroll comprises an orbiting scroll and the second scroll comprises a fixed scroll.

14. The scroll compressor according to claim 1, wherein the at least one coupling member comprises a plurality of coupling members, and wherein the plurality of coupling members passes through the plurality of coupling holes, respectively, to couple the back pressure plate and the gasket to the second scroll.

15. The scroll compressor according to claim 1, wherein the second scroll includes a fixed head plate having a disk shape that defines an upper portion of the second scroll, and wherein the gasket is seated on a top surface of the fixed head plate.

16. The scroll compressor according to claim 1, wherein a diameter of the outer circumferential surface of the gasket body is equal to or less than an outer diameter of the back pressure plate.

17. The scroll compressor according to claim 1, wherein the outer circumferential surface of the gasket body has a circular shape, and wherein the inner circumferential surface of the gasket body has a non-circular shape.

18. The scroll compressor according to claim 4, wherein the at least one embossment contacts a bottom surface of the back pressure plate.

* * * * *